US008656731B2

(12) United States Patent
Kim

(10) Patent No.: US 8,656,731 B2
(45) Date of Patent: Feb. 25, 2014

(54) REFRIGERATOR

(75) Inventor: Young-Jin Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 148 days.

(21) Appl. No.: 13/147,507

(22) PCT Filed: Feb. 2, 2009

(86) PCT No.: PCT/KR2009/000485

§ 371 (c)(1),
(2), (4) Date: Oct. 17, 2011

(87) PCT Pub. No.: WO2010/087537

PCT Pub. Date: Aug. 5, 2010

(65) Prior Publication Data

US 2012/0024003 A1 Feb. 2, 2012

(51) Int. Cl.
*F25D 3/00* (2006.01)

(52) U.S. Cl.
USPC ..... 62/389; 62/449

(58) Field of Classification Search
USPC ..... 62/337, 338, 339, 389, 449, 344; 222/146.6
See application file for complete search history.

(56) References Cited

U.S. PATENT DOCUMENTS

| | | | | | |
|---|---|---|---|---|---|
| 3,914,957 | A * | 10/1975 | Jacobs | 62/338 |
| 3,934,757 | A * | 1/1976 | Malek et al. | 141/362 |
| 3,982,406 | A | 9/1976 | Hanson et al. | |
| 5,156,021 | A * | 10/1992 | St-Gelais et al. | 62/382 |
| 6,019,447 | A * | 2/2000 | Jackovin | 312/405 |
| 6,574,984 | B1 * | 6/2003 | McCrea et al. | 62/449 |
| 7,673,463 | B2 * | 3/2010 | Tupis et al. | 62/115 |
| 7,673,471 | B2 * | 3/2010 | Egan et al. | 62/389 |
| 7,703,292 | B2 * | 4/2010 | Cook et al. | 62/135 |
| 7,805,956 | B2 * | 10/2010 | Kwon | 62/389 |
| 2004/0026946 | A1 * | 2/2004 | Reed et al. | 296/24.3 |
| 2005/0160755 | A1 * | 7/2005 | Jeong et al. | 62/318 |
| 2007/0163282 | A1 * | 7/2007 | Cushman et al. | 62/340 |
| 2007/0278141 | A1 * | 12/2007 | Patera et al. | 210/110 |
| 2008/0156022 | A1 * | 7/2008 | LeClear et al. | 62/344 |

FOREIGN PATENT DOCUMENTS

| | | | |
|---|---|---|---|
| WO | WO 2005/073124 | A2 | 8/2005 |
| WO | WO 2008/096982 | A1 | 8/2008 |

* cited by examiner

*Primary Examiner* — Mohammad M Ali
(74) *Attorney, Agent, or Firm* — Birch, Stewart, Kolasch & Birch, LLP

(57) ABSTRACT

A refrigerator is provided. The refrigerator includes a main body defining a refrigerator compartment and a freezer compartment, a door selectively closing the refrigerator compartment and the freezer compartment, respectively, a plurality of receiving members spaced apart vertically from each other in the refrigerator compartment, and a dispenser between upper and lower spaces of the receiving members, the dispenser supplying drinking water.

15 Claims, 4 Drawing Sheets

[Fig. 1]
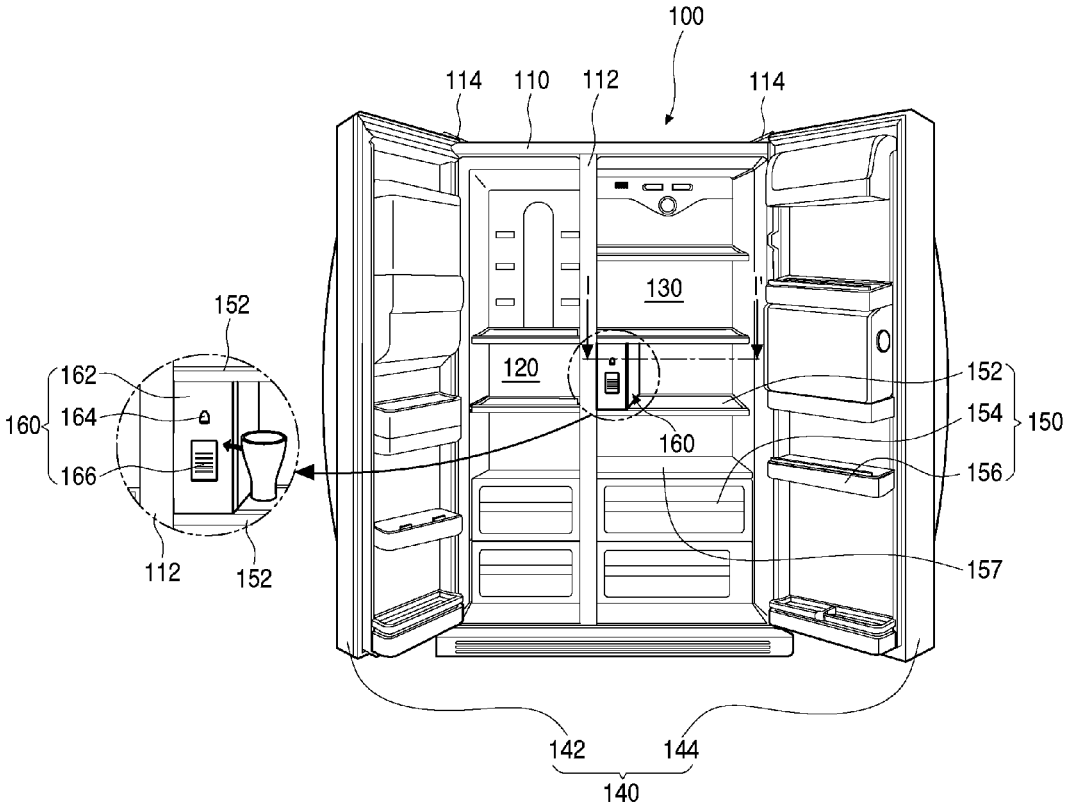
[Fig. 2]
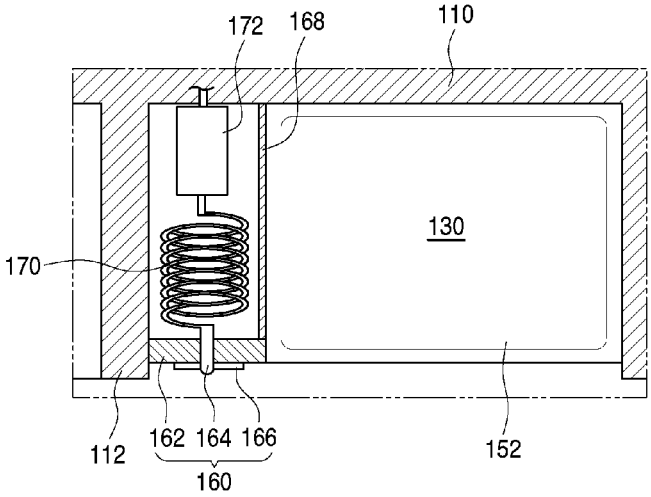

[Fig. 3]
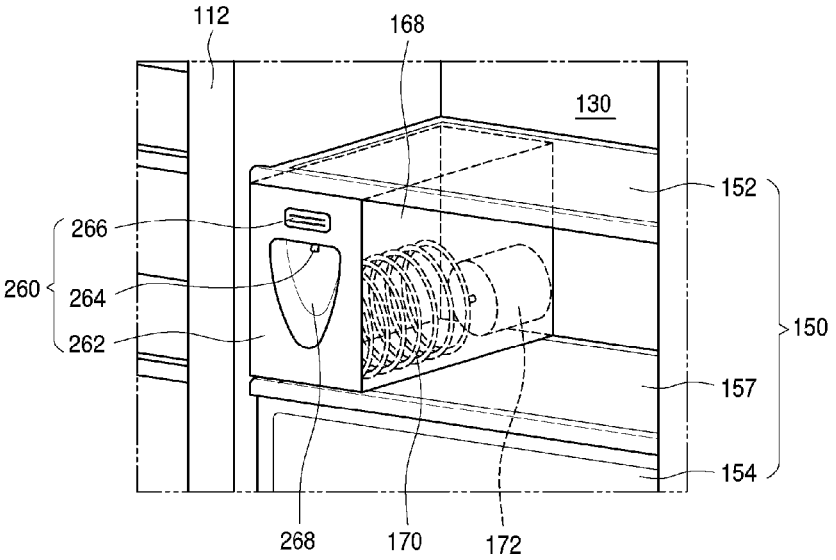
[Fig. 4]
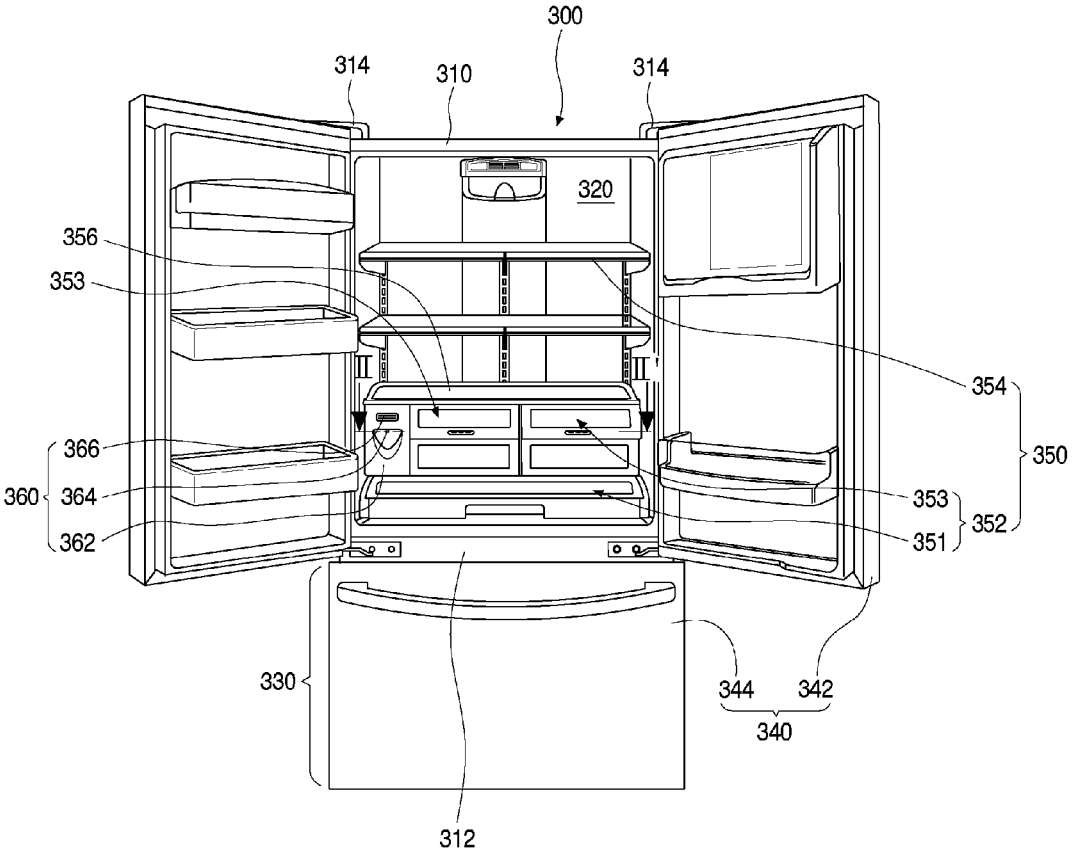

[Fig. 5]
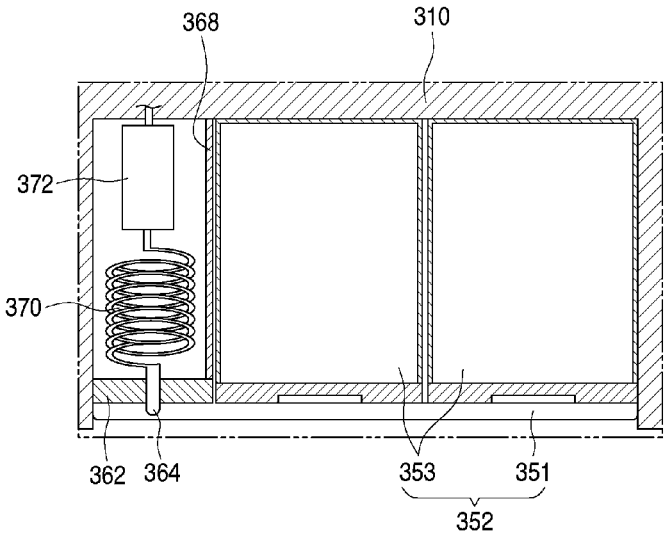
[Fig. 6]
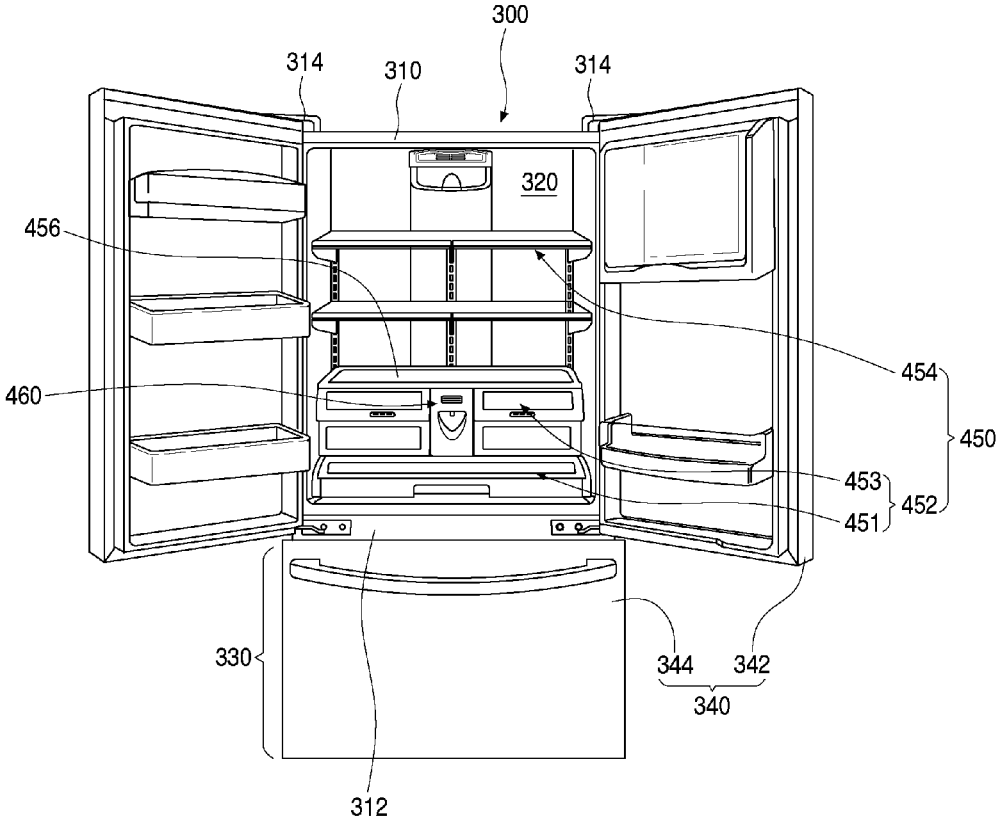

[Fig. 7]
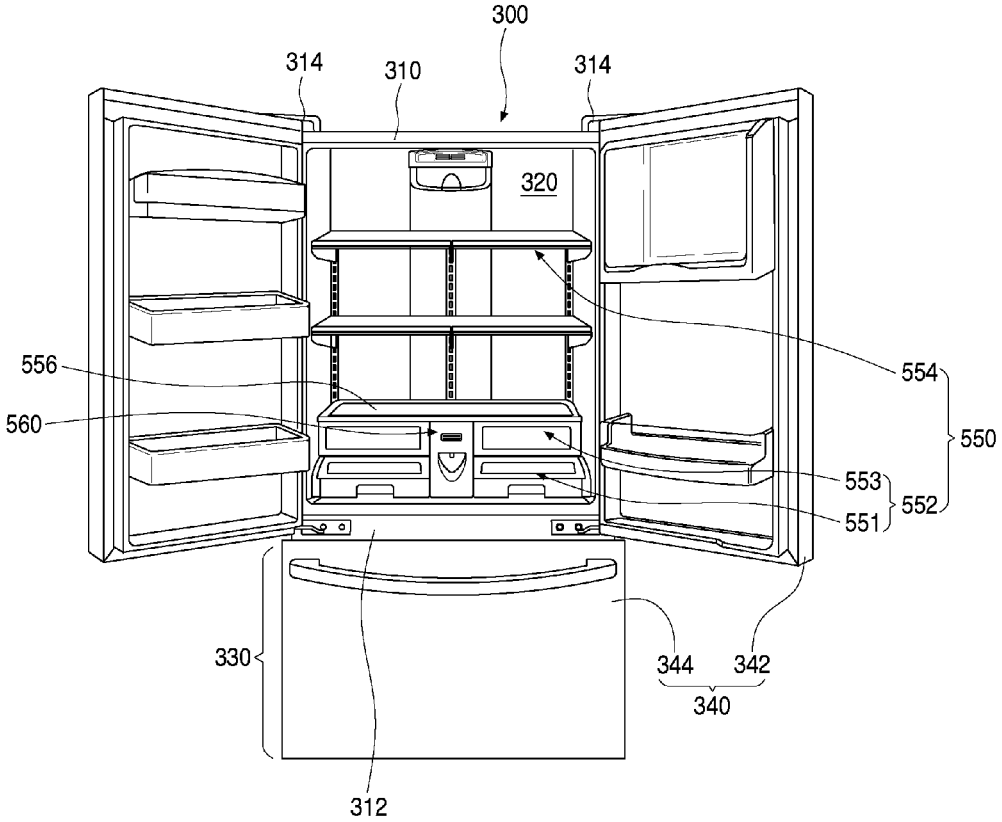

REFRIGERATOR

TECHNICAL FIELD

The present disclosure relates to a refrigerator.

BACKGROUND ART

In general, a refrigerator is an apparatus for storing foods at low temperature, and is configured to refrigerate or freeze the foods according to the state of the foods to be stored.

The inside of the refrigerator is cooled by continually supplying cool air generated through heat exchange of refrigerant in a repeating compression-condensation-expansion-evaporation cycle. The cool air supplied into the refrigerator is uniformly distributed inside the refrigerator due to convection current to enable the foods to be stored in the refrigerator at a desired temperature.

Due to a modern trend of enlarging and providing multi-functional refrigerators, brought about by diversifying user preferences and changing eating habits, a wide range of products with different configurations is being marketed.

A dispenser for dispensing water is provided in the refrigerator to improve user's convenience. Typically, the dispenser is installed in an outer surface of a refrigerator door to dispense the water.

Alternatively, the dispenser may be provided inside the refrigerator except the outer surface of the refrigerator door.

Representatively, a refrigerator in which a dispenser is provided in an inner surface of a refrigerator compartment is disclosed in U.S. Pat. No. 2,982,114. A refrigerator in which a dispenser is provided in an inner surface of a refrigerator compartment on the opposite side of a door rotation coupling part is disclosed in U.S. Pat. No. 6,810,682.

DISCLOSURE OF INVENTION

Technical Problem

Embodiments provide a refrigerator in which a dispenser is disposed between upper and lower receiving members provided to a refrigerator compartment, so that dispensing drinking water is performed in the refrigerator.

Embodiments also provide a refrigerator in which a dispenser is disposed between left and right receiving members provided to a refrigerator compartment, so that dispensing drinking water is performed in the refrigerator.

Embodiments also provide a refrigerator in which a dispenser is disposed between receiving members provided to a refrigerator compartment and a side wall of the refrigerator, so that dispensing drinking water is performed in the refrigerator.

Embodiments also provide a refrigerator in which at least one side of a dispenser for dispensing drinking water is fixed to a side of receiving members of a refrigerator compartment, so that dispensing drinking water is performed in the refrigerator.

Technical Solution

In one embodiment, a refrigerator includes: a main body defining a refrigerator compartment and a freezer compartment; a door selectively closing the refrigerator compartment and the freezer compartment, respectively; a plurality of receiving members spaced apart vertically from each other in the refrigerator compartment; and a dispenser between upper and lower spaces of the receiving members, the dispenser supplying drinking water.

In another embodiment, a refrigerator includes: a main body defining a refrigerator compartment and a freezer compartment; a plurality of receiving members spaced apart vertically from each other in the refrigerator compartment; and a dispenser between upper and lower spaces of the receiving members, the dispenser supplying drinking water, wherein the dispenser includes: a dispenser plate defining a front surface and fixed to the receiving member; a dispensing member protruding toward a front side of the dispenser plate and connected to a water tank to dispense the water; and an operation member provided to the dispenser plate, and supplying the water in a manner where the dispensing member is selectively opened by operation of a user.

In further another embodiment, a refrigerator includes: a main body defining a refrigerator compartment and a freezer compartment; a plurality of receiving members in the refrigerator compartment, a food being stored in the receiving members; and a dispenser between the receiving members on left and right sides, the dispenser being configured to dispense drinking water forward.

In still further another embodiment, a refrigerator includes: a main body defining a refrigerator compartment and a freezer compartment; a door selectively closing the refrigerator compartment and the freezer compartment, respectively; at least one drawer in the main body; and a dispenser between an inner wall surface of the refrigerator compartment and the drawer, the dispenser supplying drinking water.

The details of one or more embodiments are set forth in the accompanying drawings and the description below. Other features will be apparent from the description and drawings, and from the claims.

Advantageous Effects

According to the embodiments, the dispenser is disposed between the receiving members or between the receiving member and the side wall or the barrier, and the dispensing member for dispensing drinking water is directed forward.

Thus, accessing for dispensing the drinking water is performed on the front side so as to improve convenience in use.

In addition, the dispenser is disposed at the position corresponding to the front end of the receiving member so as to have no protrusion from the side wall or other space. Thus, interference is prevented when storing foods, so as to further improve the convenience in the use.

Also, the structures connected to the dispenser, including the water tank, the filter, and the pump are allowed to be disposed behind the dispenser, so as to improve space availability entirely.

In addition, the structures connected to the dispenser are provided in one assembly, so as to be conveniently installed to various refrigerator models, thereby improving workability and diversifying the options of products.

BRIEF DESCRIPTION OF THE DRAWINGS

FIG. 1 is a front view illustrating a refrigerator with opened doors according to an embodiment.

FIG. 2 is a cross-sectional view taken along line I-I' of FIG. 1.

FIG. 3 is a partial perspective view illustrating structure of a dispenser according to an embodiment.

FIG. 4 is a front view illustrating a refrigerator with opened doors according to another embodiment.

FIG. 5 is a cross-sectional view taken along line II-II' of FIG. 4.

FIG. 6 is a front view illustrating a refrigerator with opened doors according to another embodiment.

FIG. 7 is a front view illustrating a refrigerator with opened doors according to another embodiment.

MODE FOR THE INVENTION

Reference will now be made in detail to the embodiments of the present disclosure, examples of which are illustrated in the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

Although a side-by-side-type refrigerator and a bottom-freezer-type refrigerator are exemplified for convenience in the embodiments, the present disclosure may be applied to various types of refrigerators including a receiving member.

FIG. 1 is a front view illustrating a refrigerator with opened doors according to an embodiment. FIG. 2 is a cross-sectional view taken along line I-I' of FIG. 1.

Referring to FIGS. 1 and 2, a main body 110 of a refrigerator 100 according to the embodiment includes a compressor, a condenser, and an evaporator to perform a refrigerating cycle for generating chilly air, and a storage space is provided in the main body 110. A barrier 112 divides the storage space into left and right sides that provide a freezer compartment 120 and a refrigerator compartment 130, respectively.

The main body 110 is provided with a door 140 selectively closing the freezer compartment 120 and the refrigerator compartment 130, respectively. The door 140 includes a freezer compartment door 142 selectively closing the freezer compartment 120, and a refrigerator compartment door 144 selectively closing the refrigerator compartment 130. The refrigerator compartment door 144 and the freezer compartment door 142 are rotatably coupled to the main body 110 through hinges 114, respectively. Thus, the refrigerator compartment 130 and the freezer compartment 120 are selectively closed.

Inner space of the refrigerator compartment 130 and the freezer compartment 120, and rear surfaces of the refrigerator compartment door 144 and the freezer compartment door 142 are provided with a plurality of receiving members 150 for storing foods. The receiving members 150 include shelves 152, drawers 154, and baskets 156, and at least one part of the receiving members 150 is configured in a manner where its install position can be changed by a user.

Particularly, many of the shelves 152 and the drawers 154 are disposed in the refrigerator compartment 130. The shelves 152 and the drawers 154 divide the storage space of the refrigerator compartment 130 to improve the storing of foods.

A dispenser 160 is disposed between the two adjacent receiving members 150. The dispenser 160 is adapted to dispense drinking water according to a user's selection and is disposed toward the front side of the refrigerator compartment 130.

Particularly, the dispenser 160 is disposed between the two receiving members 150 in an approximately and vertically middle portion so that a user's hand can easily access the dispenser 160. Here, the receiving members 150 may include the drawer 154 and the shelf 152, in which one may be the shelf 152, and another may be the drawer 154.

In a case where the shelf 152 is disposed on the upper side, and the drawer 154 is disposed on the lower side, a top surface of the drawer 154 may be provided with a cover table 157 covering the top surface of the drawer 154 when the drawer 154 is inserted.

The dispenser 160 may be disposed between the receiving members 150 on the upper and lower sides, and particularly, may be in contact with the barrier 112. That is, the dispenser 160 is disposed at a position facing a side surface provided with the hinge 114, so that the dispenser 160 can be easily used without completely opening the door 140. It will be appreciated that the dispenser 160 may be spaced apart from the barrier 112 between the upper and lower receiving members 150.

The dispenser 160 includes a dispenser plate 162, a dispensing member 164, and an operation member 166. Particularly, the dispenser plate 162 provides a front appearance of the dispenser 160, and is exposed to the front side when opening the refrigerator compartment door 144.

The dispenser plate 162 is provided in an approximately tetragonal plate shape, and has a vertical length corresponding to a vertical length between the receiving members 150.

Upper and lower ends of the dispenser plate 162 respectively contact a bottom surface of the receiving member 150 disposed on the upper side, and a top surface of the receiving member 150 disposed on the lower side. At least one of the upper and lower ends of the dispenser plate 162 is fixed to the receiving member 150. A side end of the dispenser plate 162 may be fixed to a side wall in the refrigerator compartment 130 or to a side wall of the barrier 112.

A front surface of the dispenser plate 162 is flush with a front surface of the receiving member 150, so that a user can easily access the dispenser plate 162, and the basket 156 provided to the door assembly 140 is prevented to interfering with the dispenser plate 162 when normally opening and closing the door assembly 140.

The dispensing member 164 is disposed on an upper side of the dispenser plate 162. The dispensing member 164 is connected to a water tank 170 that will be described later, so that drinking water can be dispensed to the outside. The dispensing member 164 is provided in a pipe shape, and protrudes forward from the dispenser plate 162, in which an open end of the dispensing member 164 may be disposed in a downward direction or in a diagonal direction between a forward direction and the downward direction.

The operation member 166 is disposed below the dispensing member 164. The operation member 166 selectively opens a valve connected to the dispensing member 164, so as to selectively supply drinking water from the dispensing member 164. The operation member 166 may be disposed vertically below the dispensing member 164, so that the operation member 166 may be pressed and operated by a container for receiving drinking water.

The operation member 166 includes a press switch therein, and is surrounded by rubber or silicon to prevent slipping of a user's hand or a container when operating the operation member 166. The operation member 166 may be provided in a lever-type or a touch sensor-type structure.

The water tank 170 for storing drinking water supplied to the dispensing member 164 is disposed behind the dispenser plate 162. The water tank 170 may be provided in a container shape such as a related art water tank, or in a tube shape having a predetermined diameter, which is wound a plurality of times.

The water tank 170 is provided to the refrigerator compartment 130 so as to be indirectly cooled by chilly air of the refrigerator compartment 130, and is configured to supply cold water to the dispenser 160.

A filter 172 connected to the water tank 170 may be disposed behind the dispenser plate 162. The filter 172 for filtering drinking water provided to the dispenser 160, is replaceable.

A pump for pumping the drinking water to the dispenser 160 may be disposed behind a dispenser case 168. When an ice-making device for making ice is provided, a valve may be provided, which selectively guides water supply to the dispenser 160 and the ice-making device.

The dispenser case 168 may close a rear space of the dispenser 160 to have the same cross-sectional area as that of the dispenser plate 162. The dispenser case 168 covers components including the water tank 170 and the filter 172 disposed behind the dispenser plate 162 so as to be invisible from the outside. The dispenser case 168 is detachable or openable to improve maintenance and replacement of the water tank 170 and the filter 172.

The dispenser case 168 may be coupled to the dispenser plate 162 in a single module and detachable in the refrigerator. In this case, the water tank 170, the filter 172, the pump, and the valve may be disposed selectively in the dispenser case 168.

It will be appreciated that like a related art refrigerator without a discrete structure in the rear space of the dispenser 160, the water tank 170 may be disposed on the rear side of the refrigerator 100, the pump is disposed on the upper side of the refrigerator, and the pump and the valve may be provided to one side of the main body 110, e.g., to a machine compartment.

Hereinafter, operation of the refrigerator configured as described above will now be described.

To store a food in the refrigerator 100, the door 140 of the refrigerator 100 is opened and the food is stored in the receiving member 150, and the refrigerator compartment door 144 is rotated to use the dispenser 160.

As the refrigerator compartment door 144 is rotated, the inner space of the refrigerator compartment 130 is opened, and the dispenser 160 disposed between the upper and lower receiving members 150 in the refrigerator compartment 130 is exposed forward. Thus, the dispensing member 164 and the operation member 166 are exposed forward.

A container for receiving drinking water is disposed below the dispensing member 164, and then the operation member 166 is operated to dispense the drinking water. At this point, the operation member 166 may be pressed directly by the container, or operated by a user's hand.

In a case where the dispenser 160 is adjacent to the barrier 112, the operation of the operation member 166 for dispensing water is possible without fully opening the refrigerator compartment door 144.

The dispenser 160 faces forward, and is flush with the adjacent receiving members 150 so as to prevent interference in access for storing foods and dispensing drinking water.

When a desired amount of the drinking water is dispensed in the container, the operation of the operation member 166 is stopped to complete the dispensing of the drinking water. After the dispensing of the drinking water through the dispenser 160 is completed, the refrigerator compartment door 144 is closed.

Various embodiments other than the above embodiment can be applied, and another embodiment will now be described with reference to the accompanying drawing. Since this embodiment is the same as the previous one except for configuration of a dispenser, like reference numerals denote like elements and detailed description thereof will now be omitted.

FIG. 3 is a partial perspective view illustrating structure of a dispenser according to an embodiment.

Referring to FIG. 3, a dispenser 260 for dispensing drinking water is disposed between a couple of the vertically adjacent receiving members 150 in the refrigerator compartment 130.

The receiving members 150 may include the drawer 154 or the shelf 152, and as illustrated in FIG. 3, the shelf 152 may be disposed on the upper side, and the drawer 154 may be disposed on the lower side, and the dispenser 260 may be disposed between the shelf 152 and the drawer 154. A lower portion of the dispenser 260 may be in contact with the cover table 157.

The dispenser 260 includes a dispenser plate 262, a dispensing member 264, and an operation member 266. The dispenser plate 162 defines a front appearance of the dispenser 260, and has a corresponding distance to a distance between the upper and lower receiving members 150 and flush with the front surface of the receiving members 150.

One side end of the dispenser plate 262 may be in contact with the barrier 112 according to the position of the dispenser 260. That is, except for one side surface of the dispenser plate 262, the upper and lower surfaces may be in contact with the receiving members 150, and the other side surface may be in contact with the barrier 112. The dispenser plate 262 may be fixed to the receiving members 150 or the barrier 112.

The dispenser plate 262 is provided with the dispensing member 264. The dispensing member 264 is a pipe for dispensing drinking water and connected to the water tank 170. A guide part 268 is disposed below the dispensing member 264.

The guide part 268 is recessed toward the center thereof from the outer side, and protrudes to the lower side thereof from the upper side, so that a container is naturally inclined when dispensing the drinking water.

It will be appreciated that the dispenser plate 262 may be entirely inclined to improve the access of a container, so that a long container can be used without interfering with other parts in a refrigerator because of the inclination of the dispenser plate 262.

The guide part 268 is recessed with a predetermined curvature, and an approximately middle portion thereof is disposed vertically below the dispensing member 264 and recessed to the most inner side, so as to naturally guide the container below the dispensing member 264 during the access of the container.

The operation member 266 is disposed above the dispensing member 264. The operation member 266 is pressed when dispensing drinking water through the dispensing member 264. When the operation member 266 is pressed, the drinking water is dispensed through the dispensing member 264. When the pressing of the operation member 266 is stopped, the dispensing of the drinking water through the dispensing member 264 is stopped.

The dispenser case 168 is disposed behind the dispenser plate 262 to close a rear space of the dispenser plate 262. The water tank 170, the filter 172, the valve, and the pump are selectively disposed in the dispenser case 168.

Various embodiments other than the previous embodiments can be applied, and another embodiment will now be described with reference to the accompanying drawing.

FIG. 4 is a front view illustrating a refrigerator with opened doors according to another embodiment. FIG. 5 is a cross-sectional view taken along line II-II' of FIG. 4.

Referring to FIGS. 4 and 5, a main body 310 of a refrigerator 300 according to the embodiment includes a storage space therein. A barrier 312 divides the storage space into upper and lower sides that provide a refrigerator compartment 320 and a freezer compartment 330, respectively.

The main body 310 is provided with a door 340 selectively covering the storage space. The door assembly 340 includes a refrigerator compartment door 342 closing the refrigerator compartment 320, and a freezer compartment door 334 closing the freezer compartment 330. The refrigerator compartment door 342 is coupled to both sides of the main body 310 through hinges 314, so that the refrigerator compartment door 342 rotates toward the both sides to selectively close the refrigerator compartment 320.

A plurality of receiving members 350 including drawers 352 and shelves 354 are disposed in the refrigerator compartment 320, so as to divide an inner space of the refrigerator compartment 320. The shelves 354 are provided on the left and right sides, in a cantilever type structure adapted for adjusting a vertical height. The drawers 352 are disposed below the shelves 354 and drawable in a back-and-forth direction.

Among the drawers 352, a lower drawer 351 disposed above the barrier 312 is long in a lateral direction of the refrigerator compartment 320 so as to store long foods. Upper drawers 353 disposed above the lower drawer 351 are disposed on the left and right sides, and drawable independently.

The receiving members 350, that is, a side of the upper drawers 353 is provided with a dispenser 360. The dispenser 360 is used for dispensing drinking water and is disposed between an inner wall surface of the refrigerator compartment 320 and a side surface of the upper drawer 353.

Thus, when the sizes of the upper drawers 353 disposed on the left and right sides are the same as each other, a region between the upper drawers 353 leans to one side from the middle of the refrigerator compartment 320. It will be appreciated that the sizes of the upper drawers 353 may be different from each other, so as to dispose the region between the upper drawers 353 may be disposed in the middle of the refrigerator compartment 320.

The dispenser 360 has a length corresponding to a vertical height of the receiving members 350, that is, of the upper drawers 353, and has a width corresponding to a distance between an inner wall surface of the refrigerator 300 and the side surface of the upper drawer 353.

Thus, left and right side ends of the dispenser 360 are in contact with the side surface of the receiving member 350 and the inner wall surface of the refrigerator 300, respectively, and the upper end of the dispenser 360 is in contact with a bottom surface of a cover table 356 covering the top surface of the upper drawers 353, and the lower end of the dispenser 360 is in contact with a top surface of the lower drawer 351. At least one end of the dispenser 360 is connected to a corresponding object, so as to keep the fixed state the dispenser 360.

Hereinafter, configuration of the dispenser 360 will now be described in detail. The dispenser 360 includes a dispenser plate 362 and a dispensing member 364, and an operation member 366.

The dispenser plate 362 defines a front surface of the dispenser 360, and is exposed forward when opening the refrigerator compartment door 342. Left and right side ends of the dispenser plate 362 are close in contact with the inner wall surface of the refrigerator compartment 320 and the side surface of the receiving member 350, respectively. A vertical height of the dispenser plate 362 corresponds to that of the receiving members 350.

Also, a front surface of the dispenser plate 362 is flush with front surfaces of the upper drawers 353, so as to improve access when using the dispenser 360 and prevent interference with other parts.

The dispenser plate 362 is provided with the dispensing member 364 protruding forward and functioning as a passage through which drinking water is dispensed. The operation member 366 is adjacent to the dispensing member 364 to selectively adjust water supply to the dispensing member 364 by operation of a user.

A water tank 370, connected to the dispensing member 364 and adapted for storing drinking water to be dispensed, may be disposed behind the dispenser plate 362. Further more, a filter 372 for filtering water to be supplied, a pump, and a valve may be disposed behind the dispenser plate 362.

A rear surface of the dispenser plate 362 may be coupled to a dispenser case 368 that provides a space for receiving the water tank 370. The dispenser case 368 may be separately provided to be removable, or be coupled integrally with the dispenser 360 in a single module and then provided to the side of the receiving member 350.

It will be appreciated that the water tank 370, the filter 372, the pump, and the valve may be disposed in the refrigerator compartment 320 or to one side of the main body 310, not behind the dispenser plate 362.

Various embodiments other than the above embodiments can be applied, and another embodiment will now be described with reference to the accompanying drawing. Since this embodiment is the same as the previous embodiment of the FIG. 4 except for a position of a dispenser, like reference numerals denote like elements and detailed description thereof will now be omitted.

FIG. 6 is a front view illustrating a refrigerator with opened doors according to another embodiment.

Referring to FIG. 6, the refrigerator compartment 320 is provided with a plurality of receiving members 450. The receiving members 450 include height adjustable shelves 454 and drawers 452 on left and right sides. The drawers 452 include lower drawers 451 provided to the upper side of the barrier 312 dividing the main body 310 into the upper and lower portions, and upper drawers 453 provided to the upper side of the lower drawers 451.

The upper drawers 453 are disposed on the left and right sides, respectively, which are spaced apart from each other. A dispenser 460 is disposed between the receiving members 450 on the left and right sides, that is, between the upper drawers 453.

The dispenser 460 is disposed in the middle of the refrigerator compartment 320, and the upper drawers 453 have the same size and shape on the both left and right sides of the dispenser 460. The dispenser 460 has a height corresponding to the height of the upper drawers 453, and contacts the upper drawers 453 on the both sides.

A front surface of the dispenser 460 is flush with front surfaces of the upper drawers 453 on the left and right sides, and a rear space of the dispenser 460 may be selectively provided with the water tank, the filter, the pump, and the valve.

An upper end of the dispenser 460 divides horizontally the inner space of the refrigerator compartment 320 and may be closed by a cover table 456 covering the upper drawers 453.

The dispenser 460 may be disposed between the upper drawers 453 disposed on the left and right sides, or between the shelves 454 disposed on the left and right sides in the inner space of the refrigerator compartment 320.

Various embodiments other than the previous embodiments can be applied, and another embodiment will now be described with reference to the accompanying drawing. Since this embodiment is the same as the previous embodiments of the FIGS. 4 and 6 except for a position of a dispenser, like reference numerals denote like elements and detailed description thereof will now be omitted.

FIG. 7 is a front view illustrating a refrigerator with opened doors according to another embodiment.

Referring to FIG. 7, the barrier 312 divides the main body 310 into the upper and lower portions that provide the refrigerator compartment 320 and the freezer compartment 330, respectively. A plurality of receiving members 550 are disposed in the refrigerator compartment 320.

The receiving members 550 are disposed on the left and right sides of the refrigerator compartment 320, respectively. The receiving members 550 include a plurality of shelves 554 provided in a cantilever type structure adapted for adjusting a vertical height, and drawers 552 provided to the top surface of the barrier 312.

The drawers 552 are disposed on the left and right sides, respectively, which are independently drawable and may be provided in one or two stages. That is, the respective drawers 552 may be disposed on the left and right sides in the top surface of the barrier 312. Alternatively, lower drawers 551 are disposed on the left and right sides in the top surface of the barrier 312, and upper drawers 553 may be disposed on the upper side of the lower drawers 551.

A space is provided between the drawers 552 disposed on the left and right sides, in which the space between the drawers 552 is provided with a dispenser 560. The dispenser 560, for dispensing drinking water, is disposed in the approximately middle of the refrigerator, and placed on the top surface of the barrier 312.

The dispenser 560 has a width corresponding to the distance between the drawers 552 disposed on the left and right sides, and a vertical length corresponding to the height of the drawers 552. It will be appreciated that when the drawers 552 are provided in a double stage, the dispenser 560 has a height corresponding to the distance from the barrier 312 to the upper end of the upper drawers 553.

A cover table 556 is disposed on the upper sides of the drawers 552. The cover table 556 divides the refrigerator compartment 320, so that foods can be placed on the cover table 556, and the open top surface of the drawers 552 inserted can be covered. The top surface of the dispenser 560 is also covered by the cover table 556.

Thus, the left and right side ends of the dispenser 560 are in contact with the front end of the drawers 552, and the lower end and the upper end of the dispenser 560 are in contact with the barrier 312 and the cover table 556, respectively. At least one end of the dispenser 560 is coupled to at least one of the corresponding drawers 552, the barrier 312, and the cover table 556.

The front surface of the dispenser 560 may be flush with those of the drawers 552, or may be disposed more forward or more rearward than the front surfaces of the upper drawers 553 or the lower drawers 551.

In a case where the drawers 552 are not provided in the refrigerator compartment 320, the dispenser 560 may be disposed in the upper middle of the barrier 312, or be disposed between the shelves 554 on the left and right sides adjacent to the barrier 312.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Industrial Applicability

According to the embodiments, the dispenser is adjacent to the receiving member in the refrigerator compartment, so that a user's accessing for dispensing water is convenient, and various products can employ these embodiments.

The invention claimed is:

1. A refrigerator comprising:

a main body defining a refrigerator compartment and a freezer compartment, the refrigerator compartment being positioned at an upper portion of the main body;

first and second refrigerator compartment doors selectively opening and closing the refrigerator compartment, the first and second refrigerator compartment doors hinged to both edges of the main body;

a freezer compartment door selectively opening and closing the freezer compartment;

first and second drawers provided at the lower portion of the refrigerator compartment, the first and second drawers being disposed on the left and right sides and spaced apart from each other;

a cover table covering the top surface of the first and second drawers;

a dispenser provided to the refrigerator;

a case installed in a space defined by the cover and the first and the second drawers;

a water filter disposed within the case;

a water supply pipe connected to the water filter and passing through a wall of the refrigerator compartment; and a water tank connected to the filter and configured to cool water, wherein the first refrigerator compartment door covers the first drawer and the second refrigerator compartment door covers the second drawer.

2. The refrigerator according to claim 1, wherein the dispenser has a height corresponding to a height of the first and the second drawer.

3. The refrigerator according to claim 1, wherein the dispenser has a lateral width corresponding to a lateral distance between the first and the second drawers.

4. The refrigerator according to claim 1, wherein the dispenser has a front surface that is flush with a front surface of at least one of the first and the second drawers.

5. The refrigerator according to claim 1, wherein the water tank is disposed behind the dispenser.

6. The refrigerator according to claim 1, wherein the filter is disposed behind the dispenser.

7. The refrigerator according to claim 1, wherein the dispenser has a lower end that is in contact with a barrier, and the barrier divides an inner space of the main body into the refrigerator compartment and the freezer compartment to be disposed on upper and lower sides, respectively.

8. The refrigerator according to claim 1, wherein at least one portion of a front surface of the dispenser is inclined.

9. The refrigerator according to claim 1, wherein the dispenser comprises:

a dispenser plate mounted between the first and the second drawers;

a dispensing member protruding toward a front side of the dispenser plate and supplying the water; and an operation member on a side adjacent to the dispensing member, the operation member selectively opening the dispensing member.

10. The refrigerator according to claim 1, wherein the water tank is exposed into the refrigerator compartment.

11. The refrigerator according to claim 9, wherein the dispenser plate is disposed at a position corresponding to a front end of the first and the second drawers.

12. The refrigerator according to claim 9, wherein the operation member is disposed vertically below the dispensing member.

13. The refrigerator according to claim 1, wherein the dispenser is provided on a front portion of the case.

14. The refrigerator according to claim 1, wherein the water tank is provided within the case.

15. The refrigerator according to claim 9, wherein the case is installed at a middle portion of the refrigerator compartment in a horizontal direction.

* * * * *